United States Patent [19]

Schwarzkopf

[11] 4,270,459

[45] Jun. 2, 1981

[54] CHAIN-TYPE ASCENT SYSTEM FOR ROLLER COASTER

[75] Inventor: Anton Schwarzkopf, Münsterhausen, Fed. Rep. of Germany

[73] Assignee: Firma Anton Schwarzkopf Stahl- u. Fahrzeugbau, Münsterhausen, Fed. Rep. of Germany

[21] Appl. No.: 34,859

[22] Filed: Apr. 30, 1979

[30] Foreign Application Priority Data

Jul. 27, 1978 [DE] Fed. Rep. of Germany ..... 2832991

[51] Int. Cl.[3] ..... B65G 17/38; B65G 15/00

[52] U.S. Cl. ..... 104/172 B; 104/63

[58] Field of Search ..... 104/63, 172 B, 172 C, 104/243

[56] References Cited

U.S. PATENT DOCUMENTS

| | | | |
|---|---|---|---|
| 2,642,005 | 6/1953 | Cooper | 104/63 |
| 3,596,606 | 8/1971 | Smith, Jr. et al. | 104/172 B |
| 3,655,030 | 4/1972 | Hardwig | 104/172 B |
| 3,678,861 | 7/1972 | Holbert | 104/172 B |
| 3,971,325 | 7/1976 | Evans | 104/172 B |

*Primary Examiner*—Richard A. Bertsch
*Attorney, Agent, or Firm*—Karl F. Ross

[57] ABSTRACT

A chain-type ascent system for a roller-coaster has an inclined track section having a lower upstream end and a higher downstream end relative to a predetermined direction of travel of a roller-coaster car therealong. Upstream and downstream wheels are provided at the upstream and downstream ends and a pair of I-beams define a guide slot extending between these upstream and downstream wheels and along the track section. A pair of substantially parallel and endless chains are reeved over these wheels and extend along the guide slot, and a multiplicity of shoes transversely bridge between these chains at spaced-type locations therealong. Each shoe is of I-section and is engageable in and guidable by the slot, so that the chains are supported from the shoes at the slot. In addition the chains carry at least one engagement element that can engage behind and push a roller-coaster car from upstream to the downstream end of the track section. During transport the ends of the guide can be removed and the chains can be retracted inside the central part of the guide without disassembly of these chains.

10 Claims, 4 Drawing Figures

CHAIN-TYPE ASCENT SYSTEM FOR ROLLER COASTER

FIELD OF THE INVENTION

The present invention relates to a chain-type ascent system for a roller-coaster.

BACKGROUND OF THE INVENTION

A roller-coaster normally has an endless track starting and finishing at a relatively low loading and unloading station. At the beginning of each circuit of the track the roller-coaster car or cars are moved up a relatively steep incline of an initial track section whose highest point is normally the highest point on the entire track. When released from this highest point the car gains considerable kinetic energy that allows it to remount smaller slopes to follow a circuitous and normally undulating path back to the loading and unloading station.

It is obvious that in order to create a ride with maximum drawing power it is necessary to operate at maximum speed, which is achieved by providing maximum initial lift for the roller-coaster car. To this end a heavy-duty ascent system must be provided which is capable of hauling the relatively heavy weight from a relatively low point to the high point of the track.

In smaller systems this is most simply achieved by providing a continuously driven endless chain that extends upwardly along the upstream side of what is termed the starting hill of the track. This endless chain carries a multiplicity of spaced-apart engagement elements that engage behind and push the car or cars up the hill, so that once these cars reach the summit of the hill they move over the peak and down the other side under the force of gravity. There is normally provided between the loading and unloading station and the very base of the first hill a sightly downwardly inclined track section so that once the roller-coaster car or cars are loaded they can be released from this loading station and will travel downwardly to the base of the starting hill where they will be engaged by the continuously moving chain and be displaced to the top of this hill.

Such systems are completely satisfactory for small-scale roller-coasters, and can even be used in relatively large nonportable systems. It has, nonetheless, been found extremely difficult to adapt these systems to the portable roller-coasters widely used today which are transported from one carnival or fair to another. Accordingly recourse has been had to systems not using a starting hill at all, but merely firing the roller-coaster car or cars off sling-shot fashion by means of a slider that is accelerated horizontally by means of a vertically displaceable weight that is slowly hoisted to the top of the tower standing alongside the track so that the kinetic energy of this dropping weight can be imparted to the roller-coaster car or cars.

The systems employed in portable roller-coasters have all proven relatively complex to assemble and disassemble. Not only must the assemblers be quite competent, but even so such a roller-coaster frequently takes an inordinate amount of time to assemble and disassemble. In fact as much as several days can be spent putting together a portable roller-coaster and another few days taking it apart for transport to the next site.

OBJECTS OF THE INVENTION

It is therefore an object of the present invention to provide an improved chain-type roller-coaster ascent system.

Another object is to provide an improved roller-coaster startup drive system which overcomes the above-given disadvantages, that is which can be relatively easily assembled and disassembled.

A further object is to provide a roller-coaster startup drive system of the chain type which can be used to haul even a relatively large roller-coaster car or train up a relatively large initial hill, and which can nonetheless be disassembled for transport to a different location.

SUMMARY OF THE INVENTION

These objects are attained according to the instant invention in a roller-coaster startup drive system having an at least partially inclined track section having a lower upstream and a higher downstream end relative to a predetermined direction of travel of a roller-coaster car therealong. Respective upstream and downstream wheels or sprockets are provided at the upstream and downstream ends and a guide defines a slot extending between the upstream and downstream wheels and along the track section. Two substantially parallel and endless chains are reeved over these wheels and extend next to each other along the guide flanking the slot. A multiplicity of shoes are spaced apart longitudinally along these chains and each bridges transversely between these chains. Each shoe is engageable in and guidable by the slot along the track section and the chains are supported from the shoes at the slot. Drive means is provided for advancing the chain and thereby displacing the shoes in the slot from the upstream end to the downstream end. One or more engagement elements may be provided on these chains for pushing a roller-coaster car from the lower upstream end to the upper downstream end.

The use of two chains according to this invention allows them to be guided in an extremely simple manner, so that the system can be disassembled without opening up the chain, but instead by pulling the entire chain into the guide.

According to the instant invention, therefore, the entire startup drive system is mounted in a housing having a central part and upstream and downstream parts that are removable therefrom. In use the chain passes all the way between the upstream and downstream ends defined by the upstream and downstream parts. During transport, however, the upstream and downstream parts are removed and the chain is winched to the central part, normally along with the upstream and downstream wheels that are removably mounted on the upstream and downstream parts of the housing. To set the arrangement up again the upstream and downstream parts of the housing are mounted back in place and the respective wheels are pulled along them, simultaneously pulling the chains tight and moving the shoes of the chains along the upstream and downstream portions of the guide slot which are formed by these upstream and downstream housing parts. During storage or transport the chain is bunched up meander-fashion inside the central part. To this end the shoes are placed closely enough together that even when two shoes lie directly next to each other the loop of chain hanging between them does not interfere with underlying structure.

According to further features of this invention the guide is formed in each of the three housing parts by a respective pair of parallel I-beams. In fact in the upstream and downstream parts of the housing the upper and lower stretches of the chains are guided on these I-beams, the shoes being moved from a position riding between the upper flanges of the I-beams and a position riding on the lower flanges of the I-beams as they travel around the respective end wheels. This controlled guiding of these chains makes the system extremely safe and compact.

SPECIFIC DESCRIPTION

Figure 1:
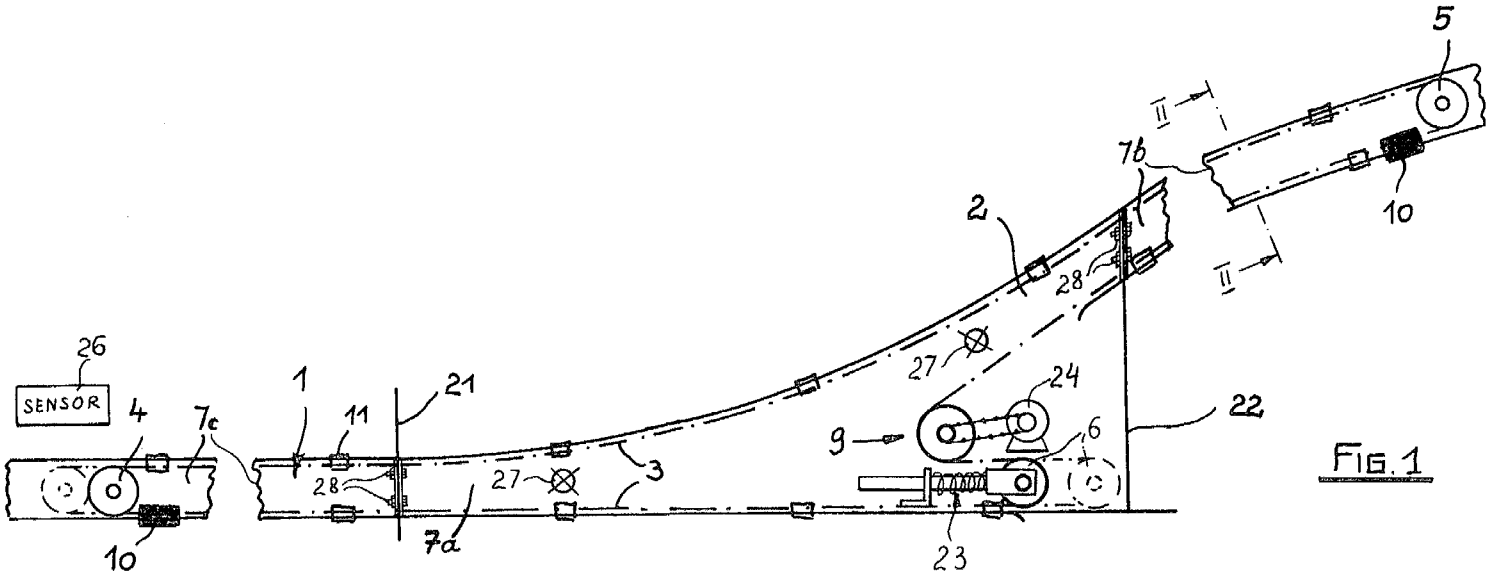
FIG. 1 is a side view of a startup drive system according to the instant invention.

As shown in FIG. 1 a startup drive system according to the instant invention has a horizontal track section 1 and an inclined track section 2. The section 1 starts at the loading station and the section 2 continues upwardly to the top of the first hill of the roller-coaster track. Beyond the portion shown in FIG. 1 the track may be formed in accordance with my copending and jointly filed application Ser. No. 034,858. Such an arrangement can be used with a roller-coaster car such as shown in my U.S. Pat. No. 3,855,936.

Figure 2:
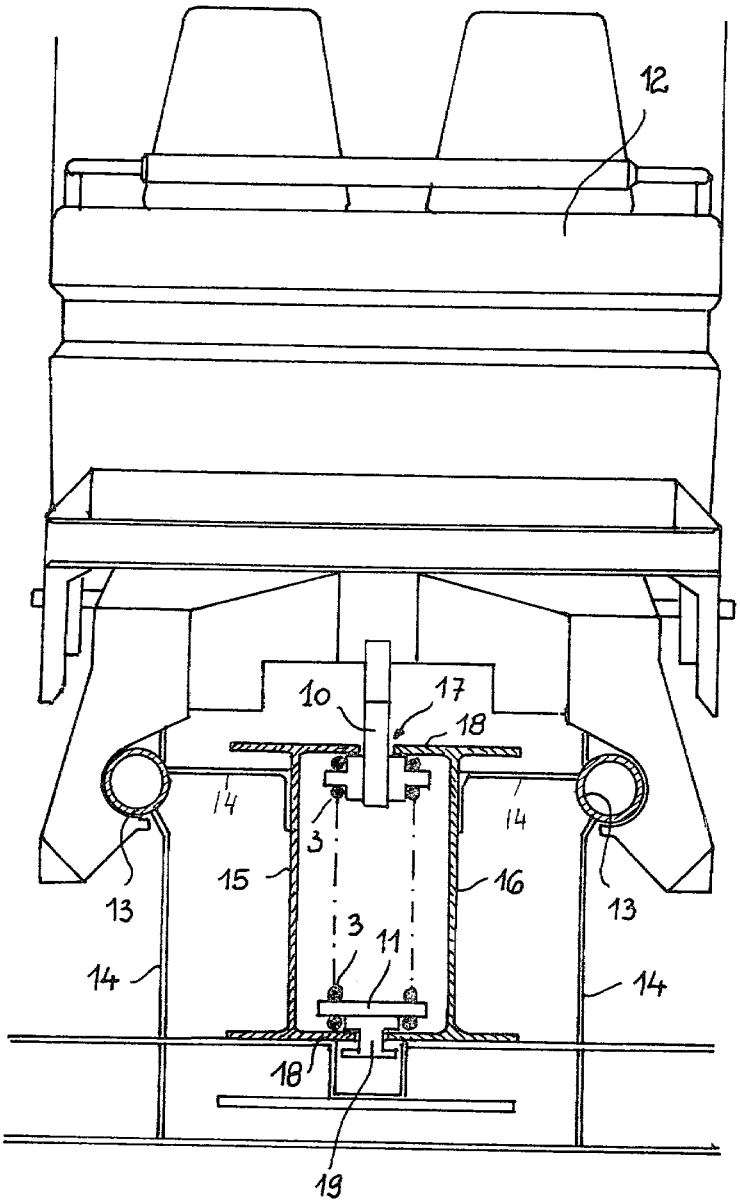
FIG. 2 is a large-scale cross section taken along line II—II of FIG. 1 and showing a rear view of a roller-coaster car riding on the track.

According to this invention the car shown at 12 in FIG. 2 is displaced along rails 13 by means of a pair of identical endless chains 3 reeved at the upstream end of the track section over an upstream wheel 4 and at the upper downstream end over a downstream wheel 5. Between these wheels 4 and 5 the chains 3 pass over a drive sprocket 9 rotatable by a motor 24 and over a tensioning roller 6 operated by a spring-loaded tensioner 23.

The chain is mounted in a housing having a central main part *7a*, an upper downstream part *7b*, and a lower upstream part *7c*. Posts 21 and 22 are provided at the joints between the parts *7a*, *7b* and *7c*.

Figure 4:
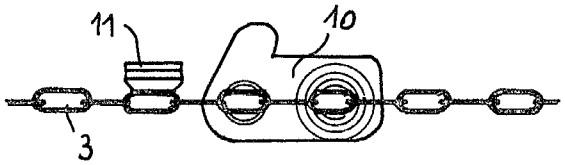
FIG. 4 is a view taken in the direction of arrow IV of FIG. 3.
Figure 3:
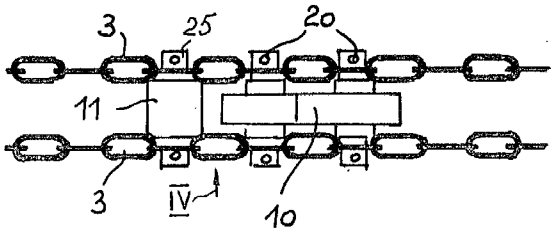
FIG. 3 is a large-scale top view of a portion of the chains according to this invention.

As best shown in FIG. 2 the upstream and downstream parts *7b* and *7c* are formed by a pair of heavy I-beams 15 and 16 to which the rails 13 are mounted by means of struts 14. The flanges 18 of these beams 15 and 16 define upper and lower spaces 17 in which I-section blocks 19 of shoes 11 mounted on the chains 3 may slide. These shoes 11 are constituted as shown in FIG. 3 as bolts 25 passing through adjacent links of the chains 3 so as to lock them together. Since the blocks 19 of the shoes 11 are guided in the slots 17 the chains 3 will follow a very accurately controlled path. It is noted that along the upper edge of the central housing part *7a* as well as the lower edge thereof the shoes 11 are similarly guided in slots similar to the slot 17 shown in FIG. 2.

In addition car-engaging hooks 10 mounted via bolts 20 identical to the bolts 25 are carried on the chains 3. Only two such engagement elements 10 are provided, spaced apart as shown in FIG. 1 so that the one can be immediately underneath the upstream end of the system while the other is immediately under the downstream end thereof. These hooks 10 can engage behind the car 12 as shown in FIG. 2 to push it from the upstream wheel 4 to the downstream wheel 5.

The chains 3 according to this invention are not continuously advanced by the motor 24. Instead a sensor 26 is provided which is connected by appropriate circuitry to the motor 24 so as to operate this motor 24 only when a car 12 is positioned above the lower upstream wheel 4. The sensor operates the motor 24 long enough to move the car 12 along the rails 13 all the way past the downstream wheel 5, where it is released to descend the other side of the first hill of the track in a manner well known in the art. As soon as the car 12 is released the chains 3 are stopped, with the next engagement element 10 being at a position ready to move behind and push along the next car 12.

The wheels 4 and 5 are releasably mounted on the respective housing parts *7c* and *7b*. When the system is to be transported the wheels 4 and 5 are released and are pulled inwardly by means of winches 27 provided on the central housing part *7a*. During this retraction the shoes 11 are also pulled inwardly along with the chains 3 until the wheels 4 and 5 and all of the chains 3 and shoes 11 lie within the central housing part *7a*. Thereafter the housing parts can be disengaged at the end posts 21 and 22 by releasing of bolts 28 so that these portions *7b* and *7c* can be transported separately. The large central section can be set on a flat-bed truck and transported to the next carnival or fair.

For reassembly the end parts *7b* and *7c* are bolted back onto the central part *7a* and the winches 27 are employed by looping of their cables through appropriate hooks at the extreme ends of the parts *7b* and *7c* to pull the wheels 4 and 5 back to their positions at the ends of these parts where they are again secured in place. Thus even through a heavy-duty dual chain arrangement is provided for the roller-coaster drive according to this invention, it is possible to knock down the main drive system into transportable pieces without having to painstakingly disassemble the chain and other critical elements. In fact the parts *7b* and *7c* have no critical structure in them during transport, as they are merely heavy-duty box-girder elements. Simply passing the axles for the wheels 4 and 5 through them when the wheels are in place ensures proper mounting, and tensioning of the chains 3 by means of the arrangement 23 further ensures rigid holding of these parts *7b* and *7c* in place.

I claim:

1. A roller-coaster startup drive system comprising:

an at least partially inclined track section having a low upstream end and a high downstream end relative to a predetermined direction of travel therealong, whereby a roller-coaster car can travel along said track section from said upstream to said downstream end;

respective upstream and downstream wheels at said upstream and downstream ends;

a pair of profile beams forming a guide and having juxtaposed flanges defining a slot extending between said upstream and downstream wheels and along said track section;

a pair of substantially parallel and endless chains reeved over said wheels and extending along said guide between said beams;

a multiplicity of shoes spaced apart along said chains and each bridging transversely between said chains, each shoe riding on said flanges in said slot, said chains being supported from said shoes at said slot inside said guide; and means for advancing said chains and thereby displacing said shoes along said beams from said upstream end to said downstream end.

2. The drive system defined in claim 1 wherein said shoes are of I-section and have flanges to either side of said slot when engaged therein.

3. The drive system defined in claim 2 wherein said guide has an upper reach forming said slot and a lower reach forming a lower slot, said shoes being engageable in and guidable by said lower slot also.

4. The drive system defined in claim 1, further comprising at least one engagement element connected to said chains and engageable by projection through said slot with a roller-coaster car on said track section.

5. The drive system defined in claim 4 wherein said drive means only advances said chains when a roller-coaster car is on said track section.

6. The drive system defined in claim 4 wherein said drive means includes control means for sensing the presence of a roller-coaster car on said track section and for operating said drive means to advance said chains only when said presence is sensed.

7. The drive system defined in claim 1 wherein said chains are substantially identical and have permanently welded links.

8. A roller-coaster startup drive system comprising:

a housing having a central part and upstream and downstream parts flanking said central part;

means releasably securing said upstream and downstream parts on said central part;

an at least partially inclined track section extending along said parts and having a low upstream end at said upstream part and a high downstream end at said downstream part relative to a predetermined direction of travel therealong, whereby a roller-coaster car can travel along said track section from said upstream end to said downstream end;

respective upstream and downstream wheels releasably mounted on said upstream and downstream parts at said upstream and downstream ends;

a guide defining a slot extending along said parts between said upstream and downstream wheels and along said track section;

a pair of substantially parallel and endless chains reeved over said wheels and extending along said guide;

a multiplicity of shoes spaced apart along said chains and each bridging transversely between said chains, each shoe being engageable in and guidable by said slot, said chains being supported from said shoes at said slot; and means for advancing said chains and thereby displacing said shoes in said slot from said upstream end to said downstream end.

9. The drive system defined in claim 8 wherein said wheels are releasably mounted on the respective upstream and downstream parts and said central part is formed to accommodate said wheels during transport.

10. The drive system defined in claim 8 wherein said guide has a pair of parallel and spaced I-beams forming said slot.

* * * * *